US005193511A

United States Patent [19]

Fujino

[11] Patent Number: 5,193,511

[45] Date of Patent: Mar. 16, 1993

[54] EVAPORATED FUEL PROCESSING APPARATUS FOR AN INTERNAL COMBUSTION ENGINE

[75] Inventor: Ryuji Fujino, Tochigi, Japan

[73] Assignee: Honda Giken Kogyo Kabushiki Kaisha, Tokyo, Japan

[21] Appl. No.: 796,259

[22] Filed: Nov. 19, 1991

[30] Foreign Application Priority Data

Nov. 27, 1990 [JP] Japan ..... 2-123697[U]

[51] Int. Cl.[5] ..... F02M 33/02

[52] U.S. Cl. ..... 123/520; 123/516

[58] Field of Search ..... 123/519, 520, 521, 516

[56] References Cited

U.S. PATENT DOCUMENTS

| | | | |
|---|---|---|---|
| 4,343,281 | 8/1982 | Uozumi | 123/519 |
| 4,702,216 | 10/1987 | Hiruta | 123/519 |
| 4,815,436 | 3/1989 | Sasaki | 123/520 |
| 4,872,439 | 10/1989 | Sonada | 123/519 |
| 4,951,643 | 8/1990 | Sato | 123/520 |
| 4,962,744 | 10/1990 | Uranishi | 123/520 |
| 5,027,780 | 7/1991 | Uranishi | 123/520 |
| 5,056,493 | 10/1991 | Holzer | 123/520 |
| 5,056,494 | 10/1991 | Kayanuma | 123/519 |

*Primary Examiner*—Carl S. Miller

*Attorney, Agent, or Firm*—Armstrong, Westerman, Hattori, McLeland & Naughton

[57] ABSTRACT

There is provided a connecting pipe 2 for communicating a fuel tank 1 and a canister 3 filled with a fuel absorbent, and a nonreturn valve 4 which is interposed in an intermediate portion of the connecting pipe 2 and is opened to allow vapor fuel to flow from the fuel tank 1 to the canister 3 only when a pressure of the fuel tank side exceeds a pressure of canister side, and there is also provided an electromagnetic switching valve 8 disposed in parallel with the nonreturn valve 4. To this electromagnetic switching valve an actuation signal is fed by a switch which operates when a fuel pump P is actuated or when a fuel filler cap is operated to open, and in response to this actuation signal the electromagnetic valve is opened to eliminate a negative pressure in the fuel tank.

6 Claims, 2 Drawing Sheets

EVAPORATED FUEL PROCESSING APPARATUS FOR AN INTERNAL COMBUSTION ENGINE

BACKGROUND OF THE INVENTION

The present invention relates to an apparatus which processes fuel vapor evaporated in a fuel tank in an internal combustion engine.

In order to prevent the fuel vapor evaporated in the fuel tank from diffusing in an atmospheric air, various evaporated fuel processing apparatus, in which the fuel vapor is fed into a canister filled with an absorbent to absorb and recover the vapor, have been conventionally proposed.

For example, one which is disclosed in the official gazette of Japanese Patent SHO 53-4171 comprises an evaporated fuel condensation tank disposed between a fuel tank and a canister to condense evaporated fuel before entering into the canister. And, in the case that a part of the evaporated fuel is not condensed in the evaporated fuel condensation tank, such a evaporated fuel not condensed in the evaporated fuel condensation tank is trapped in the canister. Furthermore, there is provided a nonreturn valve in a connecting pipe communicating to the canister so that, when the absorption in the canister is saturated, this nonreturn valve can prevent the fuel vapor from flowing backward to the fuel tank from the canister.

FIG. 1 shows such a conventional vent system that allows the fuel vapor to flow toward the canister from the fuel tank but prohibits fresh air to enter into the fuel tank from canister side or through a fuel filler cap clearance, etc.

A vent pipe 02 extending from a gaseous phase of a fuel tank 01 is connected to a charcoal canister 03, and there is provided a nonreturn valve 04 in an intermediate portion of the vent pipe 02 which allows one-way gas flow so that the fuel vapor can flow out of the fuel tank 01 along the pipe.

The nonreturn valve 04 is opened by a predetermined differential pressure ( for example 25 mmHg ). On the other hand, no negative pressure valve which allows gas flow toward a negative pressure side is provided on a fuel filler cap 06 provided at an opening of an oil feeding pipe 05 of the fuel tank 01. The fuel tank 01 has a strength sufficient to bear a negative pressure of −300 to −350 mmHg in gauge pressure.

In accordance with this vent system, even if an ambient temperature around the fuel tank is repeatedly increased and decreased within a predetermined temperature zone, the fuel vapor flows to the charcoal canister 03 only once if the vapor pressure of the evaporated fuel exceeds a set value of the nonreturn valve 04 when the temperature rises for the first time. And, after this first temperature rise, the fuel tank 01 no longer respires, therefore the evaporated fuel is surely prevented from leaking out of the fuel tank, or an atmospheric air is barred from entering into the fuel tank.

However, after an engine is stopped, when an inner pressure of the fuel tank 01 falls to be negative on account of a temperature fall, it was feared that a fuel pump becomes likely to cause a vapor look phenomenon. Or the negative pressure in the fuel tank 01 increases as the fuel in the fuel tank is consumed, therefore it was also feared that it causes an undesirable reduction of fuel feeding rate since the fuel pump cannot perform its normal function sufficiently.

Moreover, there was such a problem that it becomes hard to open the fuel filler cap 06 because the fuel cap 06 sticks fast when the negative pressure in the fuel tank 01 becomes large.

The present invention is attained in view of such problems, and the purpose of the present invention is to provide an evaporated fuel processing apparatus which is capable of preventing the fuel feeding characteristic from unexpectedly changing due to the negative pressure caused in the fuel tank.

SUMMARY OF THE INVENTION

In order to accomplish the above purpose, in accordance with the present invention, there is provided an evaporated fuel processing apparatus for an internal combustion engine comprising a connecting pipe for communicating a fuel tank and a canister filled with a fuel absorbent, a nonreturn valve which is provided in the connecting pipe and is opened to allow vapor fuel to flow from the fuel tank to the canister only when an inner pressure of the fuel tank exceeds a pressure of canister side, and the evaporated fuel processing apparatus further comprises a switching valve which is interposed between the fuel tank and the canister in parallel with the nonreturn valve.

Accordingly, since the negative pressure in the fuel tank is eliminated when the switching valve is opened, if the switching valve is controlled to open under a predetermined condition where the inner pressure of the fuel tank is likely to be negative, it becomes possible to prevent the troubles such as an undesirable reduction of fuel feeding rate in accordance with a vapor lock phenomenon in the fuel pump and consumption of the fuel in the fuel tank.

Particularly, the switching valve can be opened to eliminate above troubles when the fuel pump is working.

Further, if the switching valve is opened when the fuel filler cap is opened, it becomes easy to open the fuel filler cap since the fuel filler cap is no longer stuck fast on the opening of fuel feeding pipe.

BRIEF DESCRIPTION OF THE ACCOMPANYING DRAWINGS

DETAILED DESCRIPTION OF THE PREFERRED EMBODIMENT

Figure 1:
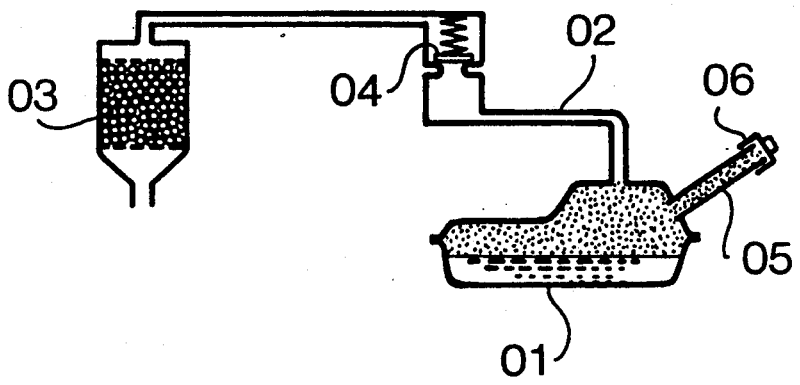
FIG. 1 PRIOR ART
FIG. 1 is a schematic view showing a conventional vent system.
Figure 2:
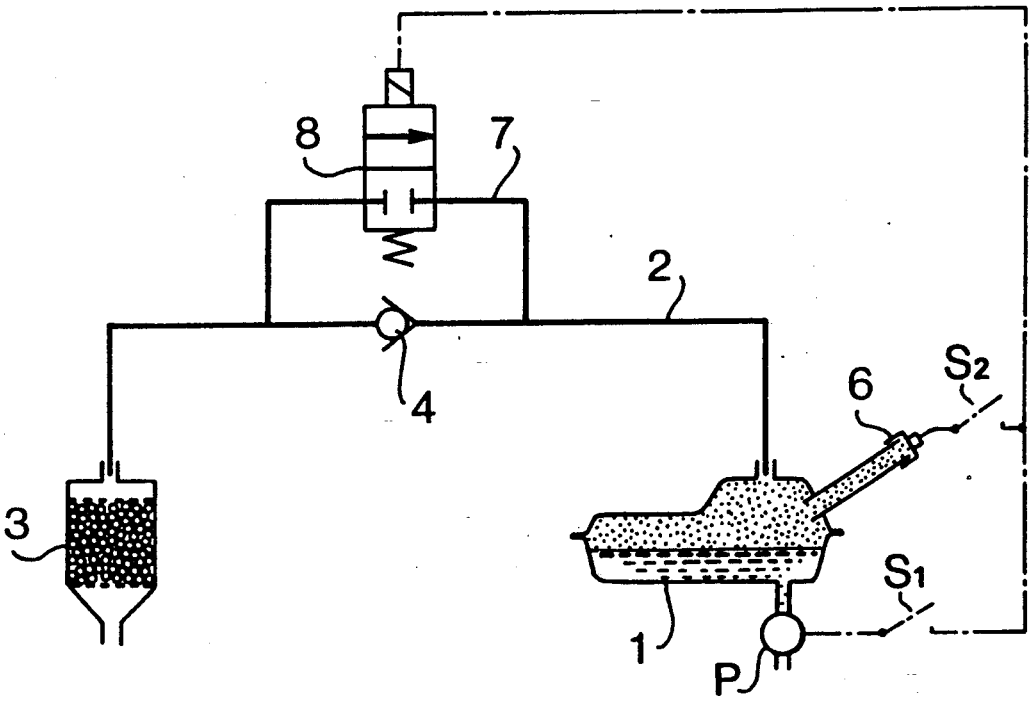
FIG. 2 is a schematic view showing one embodiment of the vaporized fuel processing apparatus in accordance with the present invention.
Figure 3:
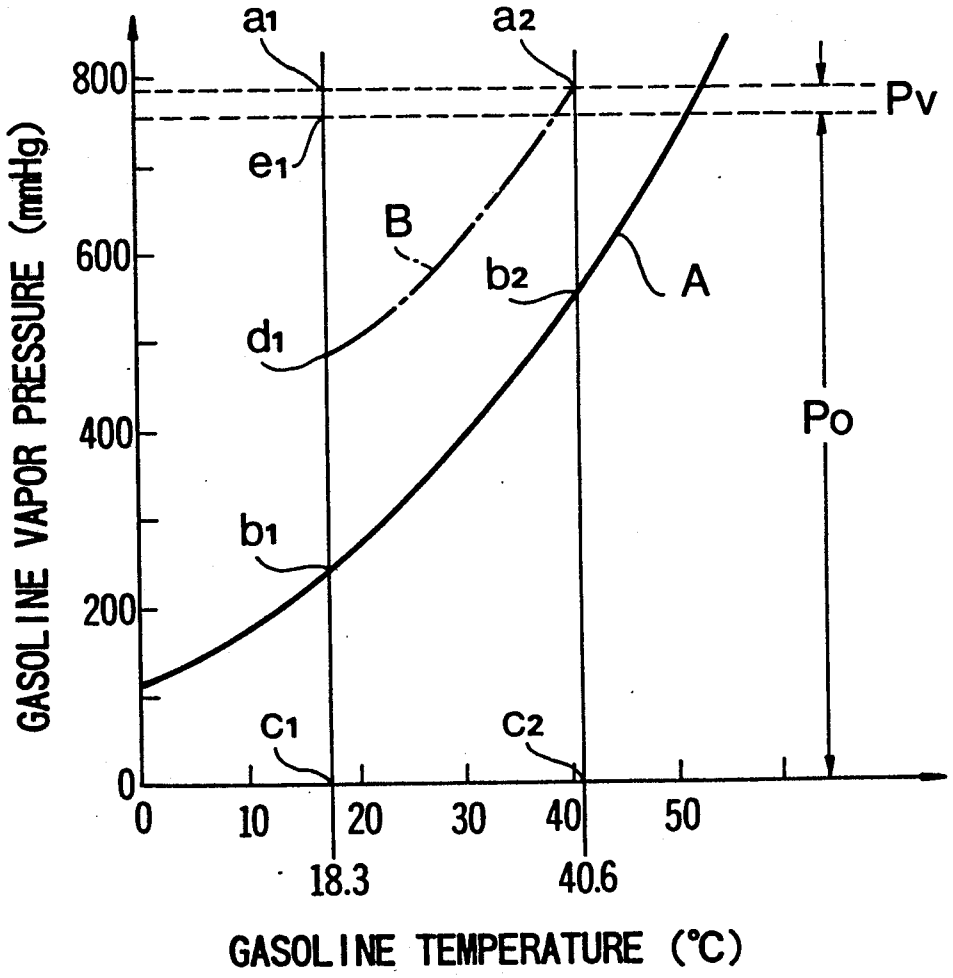
FIG. 3 is a graph illustrating pressure change in the fuel tank.

Referring now to FIGS. 2 and 3, one preferred embodiment of the present invention is hereinafter described in detail.

A fuel tank 1 has a strength sufficient to bear a negative pressure of −300 to −350 mmHg in gauge pressure, and there is not provided a negative pressure valve on a fuel filler cap 6 covering an opening of an oil feeling pipe 5 of the fuel tank 1 which allows gas flow toward a negative pressure side.

There is provided a nonreturn valve 4 in an intermediate portion of a vent pipe 2 provided as a connecting pipe for connecting a gaseous phase of the fuel tank 1 and the charcoal consider 3 so that fuel vapor can flow only in a direction from the fuel tank 1 to the charcoal canister 3.

The differential pressure Pv set to open the nonreturn valve 4 is about 25 mmHg. That is, the nonreturn valve 4 opens only when the inner pressure of the fuel tank 1 become lager than an atmospheric pressure Po (i.e. a pressure in the canister) by an amount of Pv.

An additional connecting pipe 7 is disposed between a fuel tank side and a canister side of the nonreturn valve 4 to connect therebetween, and there is provided an electromagnetic switching valve 8 in this connecting pipe 7.

That is, the electromagnetic switching valve 8 is interposed between the fuel tank 1 and the charcoal canister 3 in parallel with the nonreturn valve 4. The electromagnetic switching valve 8 is a normally-closed type, which opens when a solenoid actuates in response to a control signal.

The evaporated fuel processing apparatus in accordance with the present embodiment is composed as is explained in the foregoing description, and the vent system is established in the condition where the electromagnetic switch valve 8 is closed.

FIG. 3 is a graph showing a relationship between gasoline vapor pressure and temperature in the fuel tank 1, with an abscissa representing gasoline temperature (°C.) and an ordinate representing gasoline vapor pressure (mmHg).

In the drawing, a curve A shown a gasoline saturated vapor pressure curve, the total pressure int he fuel tank 1 is divided into a partial pressure of a gasoline vapor indicated by a lower part below the curve A and a partial pressure of air shown as upper part of the curve A.

Now, it is supposed that gasoline having a temperature a little bit lower than 18.3° C. (60° F.) is entered into the fuel tank 1, and after the fuel filler cap 6 is closed, it is calmly laid in an atmosphere of 18.3° C.

If sufficient time has elapsed by keeping above condition , a gasoline vapor pressure in the gaseous phase in the fuel tank 1 reaches a saturated vapor pressure. In this instance, total pressure in the fuel tank ( absolute pressure) is controlled by the nonreturn valve 4, therefore which indicates to be Po+Pv ($\overline{a_1c_1}$), wherein the partial pressure of the gasoline vapor is $\overline{b_1c_1}$ and the partial pressure of air is $\overline{a_1b_1}$.

If the atmospheric temperature is gradually increased up to for example 40.6° C. (105° F. )from this condition, air shows a thermal expansion in proportion to an absolute temperature, and the partial pressure of the gasoline vapor increases exponentially as shown by the curve A. However, since the nonreturn valve 4 opens to allow a mixture comprising gasoline vapor and air to flow toward the charcoal canister 3, the inner pressure in the fuel tank can be kept at an absolute pressure of $\overline{a_1c_1}$ ( Pv in the gauge pressure ).

In such a way, when the temperature rises for the first time, the gasoline vapor is scavenged out of the fuel tank 1 through the ventilation pipe 2 and is trapped by the charcoal canister 3.

When the atmosphere temperature is 40.6° C., total pressure in the fuel tank is $\overline{a_2c_2}$ (=$\overline{a_1c_1}$), wherein the partial pressure of the gasoline vapor is $\overline{b_2c_2}$ and the partial pressure of air is $\overline{a_2b_2}$.

Next, if the atmosphere temperature is gradually reduced from 40.6° C. to 18.3° C., the gasoline vapor in the gaseous phase in the fuel tank is condensed and the air is shrunk. However, during this time the nonreturn valve 4 is closed and therefore outside air dose not enter into the tank, thus the inner pressure of the fuel tank reduces along a curve B indicated by an alternate long and short dash line from a point $a_2$ to reach a point $d_1$ at the temperature of 18.3° C. That is, the inner pressure of the fuel tank becomes an absolute value of $\overline{d_1c_1}$ ( minus $\overline{d_1e_1}$ in the gauge pressure ).

By the way, strictly speaking, since a number of molecules of air is reduced from the initial condition, the inner pressure is further lowered a little bit.

After this, if the atmospheric temperature is again increased from 18.3° C. to 40.6° C., the inner pressure of the fuel tank increases along the curve B to reach the point $a_2$, and next if the atmospheric temperature is lowered to the temperature of 18.3° C., the inner pressure of the fuel tank is decreased along the curve B to reach the point $d_1$.

That is, after the atmospheric temperature is once increased to 40.6° C., even if the atmospheric temperature is repeatedly raised and lowered between 18.3° C. and 40.6° C., the inner pressure of the fuel tank merely reciprocates between the point $d_1$ and the point $a_2$ along the curve B, and the gasoline vapor in the fuel tank 1 cannot be scavenged out of the fuel tank.

As is apparent from the foregoing description, there is established such a vent system that the gasoline vapor is scavenged out of the fuel tank only when the temperature has increased for the first time, and is not scavenged any more by the succeeding repetition of temperature rise and fall.

In the present embodiment, in accordance with such an evaporated fuel processing apparatus, the electromagnetic switching valve 8 is provided in parallel with the nonreturn valve 4, and the actuating signals are fed to the electromagnetic switching valve to open this switching valve in response to the operation of switches S1 and S2 which respond when the fuel pump P is working and a fuel filler lid is opened, respectively.

Accordingly, even if the fuel pump is actuated under the condition that the atmospheric temperature around the fuel tank 1 falls and the inner pressure of the tank 1 is reduced to cause a larger negative pressure, the vapor lock phenomenon occurring in the fuel pump due to negative pressure can be surely prevented from occurring since the electromagnetic switching valve 8 opens in response to the actuation of the fuel pump to increase the inner pressure of the fuel tank.

Moreover, since the electromagnetic switching valve 8 is opened during the operation of the fuel pump, such a phenomenon that the inner pressure of the fuel tank 1, reaches a large negative pressure due to the consumption of the fuel in the fuel tank 1 no longer occurs. Therefore, it becomes possible to prevent that the amount of fuel fed from the fuel pump is undesirably decreased by being influenced by the large negative pressure in the fuel tank, therefore it becomes possible to maintain the required fuel feeding amount in any time.

Furthermore, though there was a problem such that the fuel filler cap 6 sticks on a cap seat on the opening of the fuel feeding pipe 5 due to the negative pressure in the fuel tank too fast to easily open the fuel filler cap 6, the fuel filler cap 6 in accordance with the present embodiment can be easily opened since the electromagnetic switching valve 8 is controlled to open in response to the opening operation of the fuel filler cap to eliminate the negative pressure in the fuel tank.

What is claimed is:

1. An evaporated fuel processing apparatus for an internal combustion engine having a fuel pump, a connecting pipe for communicating a fuel tank and a canister filled with a fuel absorbent, and, a nonreturn valve which is provided in an intermediate portion of the connecting pipe and is openable in response to a pressure difference to allow vapor fuel to flow from the fuel tank to the canister only when a pressure within the fuel tank side of the connecting pump exceeds a pressure within the canister side of the connecting pipe, comprising:

a switching valve which is interposed between the fuel tank and the canister in parallel with the nonreturn valve; and switching means for opening said switching valve when the fuel pump is in operation.

2. An evaporated fuel processing apparatus for an internal combustion engine having an openable fuel filler cap, a connecting pipe for communicating a fuel tank and a canister filled with a fuel absorbent, and, a nonreturn valve which is provided in an intermediate portion of the connecting pipe and is openable in response to a pressure difference to allow vapor fuel to flow from the fuel tank to the canister only when a pressure within the fuel tanks side of the connecting pipe exceeds a pressure within the canister side of the connecting pipe, comprising:

a switching valve which is interposed between the fuel tank and the canister in parallel with the nonreturn valve; and switching means for opening said switching valve when the fuel pump is in operation; and a switching means for opening said switching valve when the fuel filler cap is operated to open.

3. An evaporated fuel processing apparatus for an internal combustion engine having a fuel pump, comprising:

a connecting pipe for communicating a portion of a fuel tank containing fuel vapor and a canister filled with a fuel absorbent;

a nonreturn valve disposed in an intermediate portion of said connecting pipe to selectively open and close communication between the fuel tank and the canister, said nonreturn valve being openable in response to a pressure difference within said connecting pipe to allow vapor fuel to flow from the fuel tank to the canister only when a pressure within the fuel tank side of the connecting pipe exceeds a pressure within the canister side of the connecting pipe;

a switching valve conduit having one end in communication with the fuel tank side of said connecting pipe and having another end in communication with the canister side of said connecting pipe;

a switching valve means for selectively opening and closing communication between the fuel tank and the canister, said switching valve means being disposed in an intermediate portion of said switching valve conduit, said switching valve being selectively openable in response to a control signal to allow vapor fuel to flow from the canister to the fuel tank only when the control signal is received; and switching means for supplying the control signal to said switching valve means, for causing opening of said switching valve when the fuel pump is in operation.

4. An evaporated fuel processing apparatus for an internal combustion engine supplied with fuel from a fuel tank, the fuel tank having an openable fuel filler cap, comprising:

a connecting pipe for communicating a portion of a fuel tank containing fuel vapor and a canister filled with a fuel absorbent;

a nonreturn valve disposed in an intermediate portion of said connecting pipe to selectively open and close communication between the fuel tank and the canister, said nonreturn valve being openable in response to a pressure difference within said connecting pipe to allow vapor fuel flow from the fuel tank to the canister only when a pressure within the fuel tank side of the connecting pipe exceeds a pressure within the canister side of the connecting pipe;

a switching valve conduit having one end in communication with the fuel tank side of said connecting pipe and having another end in communication with the canister side of said connecting pipe;

a switching valve means for selectively opening and closing communication between the fuel tank and the canister, said switching valve means being disposed in an intermediate portion of said switching valve conduit, said switching valve being selectively openable in response to a control signal to allow vapor fuel to flow from the canister to the fuel tank only when the control signal is received;

switching means for supplying the control signal to said switching valve means, for causing opening of said switching valve when the fuel filler cap is operated to open.

5. An evaporated fuel processing apparatus for an internal combustion engine as claimed in claim 3, the combustion engine being supplied with fuel from a fuel tank which has an openable fuel filler cap, wherein said switching means is a first switching means, and further comprising a second switching means for supplying the control signal to said switching valve means, for causing opening of said switching valve when the fuel filler cap is operated to open.

6. An evaporated fuel processing apparatus for an internal combustion engine as claim in claim 3, further comprising a connecting conduit for communicating a region of the fuel tank containing liquid fuel and the fuel pump.

* * * * *